United States Patent [19]

Münch et al.

[11] Patent Number: 4,793,762

[45] Date of Patent: Dec. 27, 1988

[54] PACKING AND UNPACKING MACHINE

[75] Inventors: Karl Münch, Heppenheim; Hans W. Holzer, Worms, both of Fed. Rep. of Germany

[73] Assignee: SEITZ ENZINGER NOLL Maschinenbau Aktiengesellschaft, Mannheim, Fed. Rep. of Germany

[21] Appl. No.: 64,992

[22] Filed: Jun. 19, 1987

[30] Foreign Application Priority Data

Jun. 20, 1986 [DE] Fed. Rep. of Germany ..... 3620717

[51] Int. Cl.[4] ..... B65G 65/00

[52] U.S. Cl. ..... 414/416; 414/225; 414/744.2; 53/250

[58] Field of Search ..... 414/416, 417, 744 A, 414/72, 744 B, 744 C, 744 R, 71, 120, 121, 122, 225; 53/48, 49, 249, 250

[56] References Cited

U.S. PATENT DOCUMENTS

| | | | |
|---|---|---|---|
| 1,654,091 | 12/1927 | Peiler | 414/744 B X |
| 2,431,320 | 11/1947 | Fischer | 414/416 |
| 2,897,988 | 8/1959 | Enock et al. | 414/416 |
| 2,966,995 | 1/1961 | Steinle | 414/416 |
| 3,185,328 | 5/1965 | Davdaine et al. | 414/416 |
| 3,218,069 | 11/1965 | Halberschmidt | 414/744 B X |

FOREIGN PATENT DOCUMENTS

| | | | |
|---|---|---|---|
| 1035559 | 5/1959 | Fed. Rep. of Germany . | |
| 3336766 | 8/1985 | Fed. Rep. of Germany . | |
| 3434009 | 3/1986 | Fed. Rep. of Germany | 414/225 |

*Primary Examiner*—Frank E. Werner

*Attorney, Agent, or Firm*—Becker & Becker, Inc.

[57] ABSTRACT

A packing or unpacking machine having conveyor tracks for articles and containers, with transfer units that are guided in a circular path above these conveyer tracks. Each of the transfer units has a pick-up and carrier head on a support element that can be raised and lowered. A movement mechanism is provided for generating a relative movement for the pick-up and carrier heads relative to the support elements, with this relative movement being superimposed over the rotational movement of the support elements, so that during respective rotation of the support elements, which follow the circular path, the pick-up and carrier heads are moved in a common elliptical or elliptical-like overall path of revolution. In so doing, the respective pick-up and carrier heads are moved about a vertical axis such that a constant parallel position is maintained relative to the conveyer tracks. In this way, not only are the pick-up and carrier heads moved in the transport direction of the conveyer tracks for a period of time that is sufficient to permit reliable pick-up or depositing of the articles, but also a smooth, quiet rotation of the pick-up and carrier heads in the overall path of revolution is achieved.

19 Claims, 9 Drawing Sheets

PACKING AND UNPACKING MACHINE

BACKGROUND OF THE INVENTION

The present invention relates to a machine for the packing or unpacking of articles into or out of containers, especially bottles into or out of bottle boxes, with the machine including a conversion mechanism, for the articles, that is associated with conveyer tracks for the articles and the containers. The conveyer tracks extend parallel to one another, and lead to and away from the sides of the machine. The conversion mechanism is provided with one or more transfer units that can be moved in a circular path, about a vertical central axis, into and out of the regions above the two conveyer tracks. Each transfer unit includes a pick-up and carrier head on a support element that can be raised and lowered in a controlled manner within the appropriate region of the conveyer tracks. The pick-up and carrier head is provided with means for receiving, transporting in a suspended manner, and depositing a group of the articles associated with an accommodating space within a container. The pick-up and carrier head is also provided with means for aligning a respective container.

A machine of this general type for loading or unloading open boxes of bottles is known from German Pat. No. 1 035 559 Steinle dated May 27, 1959, corresponding to U.S. Pat. No. 2,996,995, Steinle dated Jan. 3, 1961, where a conversion mechanism for the bottles is disposed on three conveyer tracks that are arranged parallel to one another. These conveyer tracks include one for delivering the bottle boxes, one for carrying off the bottle boxes, and one for delivering or withdrawing the bottles. The conversion mechanism contains four transfer units that are rotated in a circular path and are associated with a rotary carriage. Each transfer unit includes a pick-up and carrier head for the bottles, and a pick-up and carrier mechanism for the bottle boxes. With this last-mentioned pick-up and carrier mechanism, the bottle boxes are received from the conveyer track that delivers them, are carried along on half of the circular movement path of the transfer unit, and are then deposited on the withdrawal conveyer track. Along this half of the movement path, the pick-up and carrier head for the bottles is lowered relative to the pick-up and carrier mechanism for the bottle boxes, and is again raised in order during the rotation of the transfer unit to be able to place the bottles into the respective bottle box or to be able to remove the bottles from the respective bottle box. Due to the necessity for having to remove the bottle boxes from a conveyer track and having to place them on a different conveyer track, considerable additional expense is required with this heretofore known loading and unloading machine, not only with regard to the additional pick-up and carrier mechanisms for the bottle boxes on the transfer units themselves, and to the transfer mechanisms or receiving mechanisms for the bottle boxes required on the conveyer tracks for the latter, but also with regard to precise control for the receiving and transfer of the bottle boxes. Furthermore, for the sake of operational reliability, such known loading and unloading machines can be operated only slowly, so that it is possible to achieve only a limited through put capacity.

It is therefore an object of the present invention to significantly improve a loading and unloading machine of the aforementioned general type such that during loading or unloading the yet sufficient time remains in order to reliably place the articles in the container or remove the articles therefrom, while the respective container travels further on its conveyer track. Movements derived from purely rotational or circular movements should be used, with these movements being smooth and as free as possible from abrupt changes in movement.

BRIEF DESCRIPTION OF THE DRAWINGS

The objects, and other objects and advantages of the present invention, will appear more clearly from the following specification in conjunction with the accompanying schematic drawings, in which.

SUMMARY OF THE INVENTION

Figure 1:
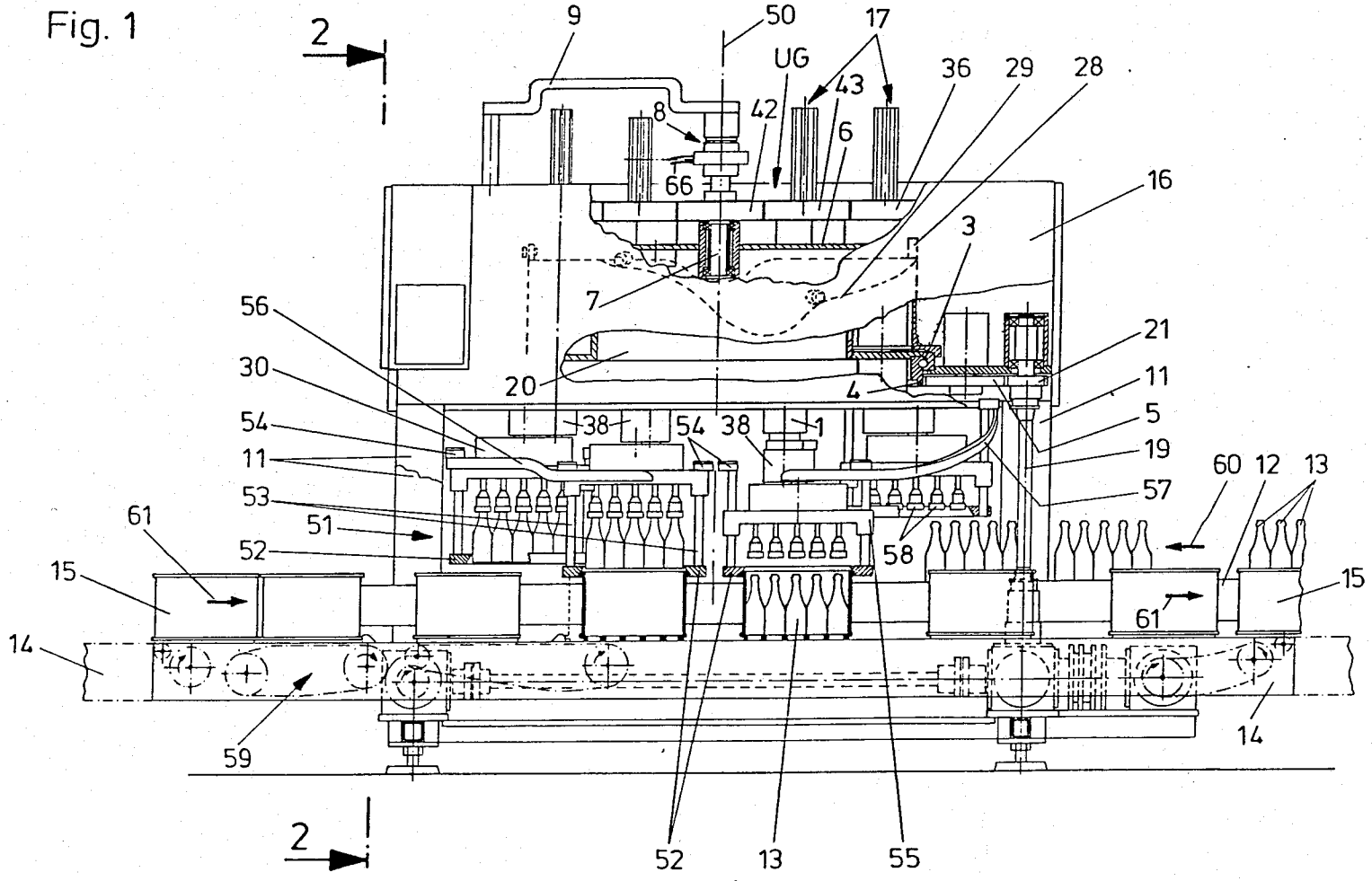
FIG. 1 is a side view of one exemplary embodiment of the inventive packing and unpacking machine.

The packing and unpacking machine of the present invention is characterized primarily by a movement mechanism for producing a relative movement between the pick-up and carrier heads and the support elements, with this relative movement being superimposed over the rotational movement of the control elements; the movement mechanism is embodied in such a way that during a respective rotation of the support elements in a circular path about the central axis, the pick-up and carrier heads are moved in a common elliptical or elliptical-like overall path of revolution that has a center point disposed on the central axis. Each pick-up and carrier head is moved about a vertical axis such that a constant parallel position is maintained relative to the conveyer tracks, with the major axis of the overall path of revolution being disposed between the conveyer tracks and parallel thereto.

The inventive packing or unpacking machine is distinguished by a straightforward construction, a simple development of the movement of the pick-up and carrier head for the article, and by a smooth and continuously operating change of movement of the pick-up and carrier head. When viewed from the top, the pick-up and carrier head always retains its parallel position relative to the conveyer tracks. The change in movement of the pick-up and carrier head during rotation of the transfer unit corresponds to a sine curve. Despite the fact that the pick-up and carrier heads are guided practically parallel to the conveyer tracks for a considerably longer period of time, the transfer units can be moved along a circular path and can therefore be mounted on a machine part that revolves in a circular movement, for example a rotary carriage type machine part. Above all, it is possible to eliminate all drawing elements, such as chains and the like, for the movement of the transfer units along the path of rotation. It has been attempted with packing and unpacking machines to move the transfer units along guide elements that in the region of the conveyer tracks have essentially linear guide parts and in the regions between the conveyer tracks have semicircular guide parts. However, it has been proven that with such fundamental designs, considerable jolts occur as the movement progresses; these jolts can be mitigated only at considerable expense. Above all, with this basic design of the drawing element, for example a chain, which keeps the transfer units rotating, and with all its considerable drawbacks, cannot be eliminated (see German Pat. No. 33 36 766 Stadler et al dated Aug. 14, 1985).

Although it is conceivable to generate the relative movement of the pick-up and carrier head in the transfer unit, which relative movement is determined by the primary rotational movement of the transfer unit or units, via additional electrical, pneumatic, or hydraulic drive mechanisms that are controlled as a function of the primary rotational movement, it is particularly advantageous within the scope of the present invention to drive the relative movement of the respective pick-up and carrier head directly, and via mechanical transmission elements, from the primary rotational movement thereof in the same way as the rotational movement of the pick-up and carrier head relative to the transfer unit to maintain a constant parallel position of the pick-up and carrier head relative to the conveyer tracks.

Although in the interest of smoothness of the movement progress absolute linear guidance of the pick-up and carrier head above the conveyer tracks is dispensed with, this does not make it more difficult to remove or place the articles from or onto the appropriate conveyer track, while a slight lateral shifting of the container on its conveyer track can be carried out easily for precisely placing articles therein or reliably removing articles therefrom.

The inventive packing and unpacking machine can either have a central drive column, or the central portion of the machine can also be kept free.

Further specific features of the present invention will be described in detail subsequently.

DESCRIPTION OF PREFERRED EMBODIMENTS

Figure 4:
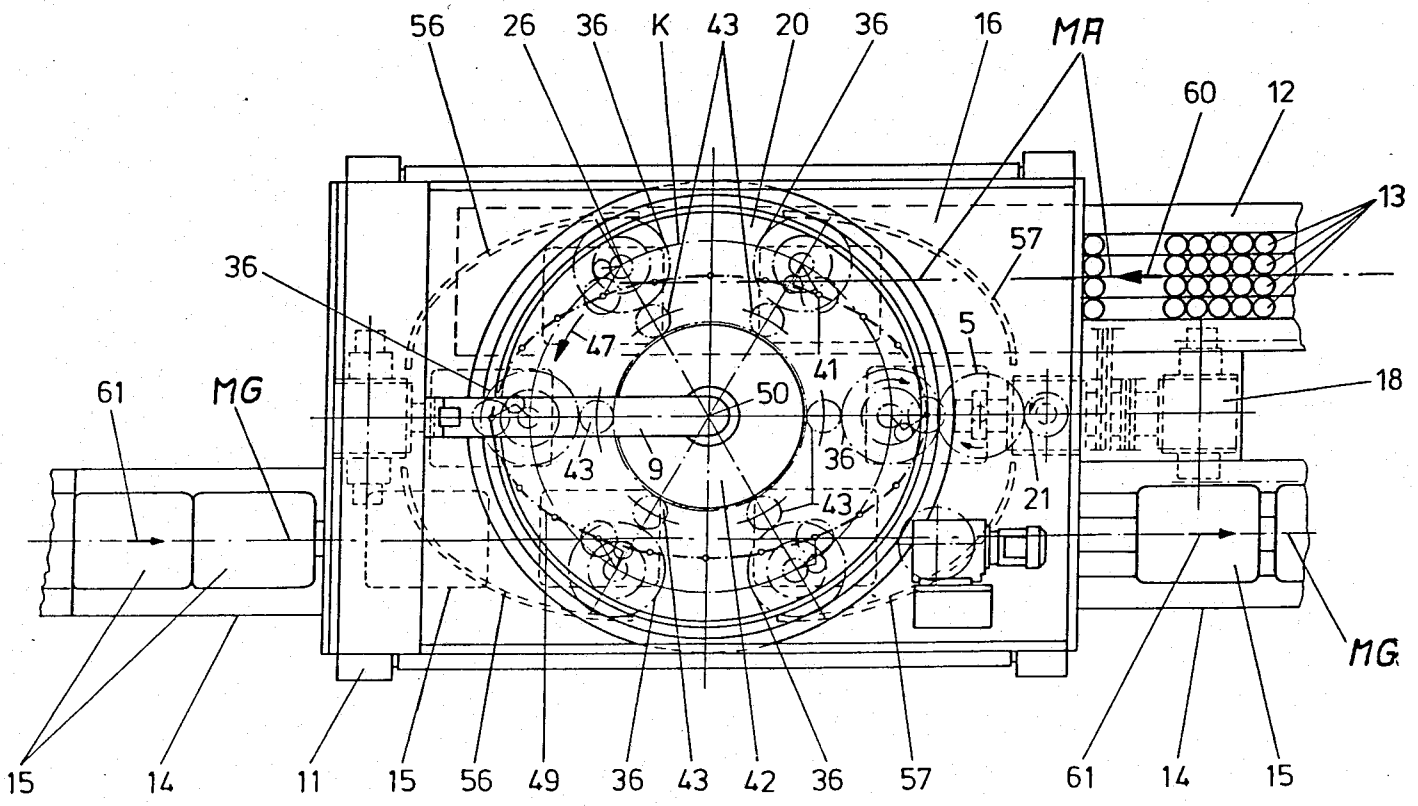
FIG. 4 is a plan view of the machine of FIGS. 1 and 2.

Referring now to the drawings in detail, in the illustrated embodiments the packing and unpacking machine is provided with a door or gate-like machine frame 11 through which pass, parallel to one another, a conveyer track 12 for articles, namely bottles 13, and a conveyer track 14 for containers, namely bottle boxes 15. The upper part of the machine frame 11 supports a machine housing 16 in which a number, for example six, of transfer units 17 are guided along a circular path K (see FIGS. 4, 5, and 7) for carrying out a primary rotational movement. The transfer units 17 are connected to appropriate drive units, and are furthermore provided with pick-up and carrier heads 30 that are held by support elements 1 which can be raised and lowered. The drive units for the transfer units 17 are also used to drive a movement mechanism that is similarly provided on the machine housing 16, and that serves to generate a relative movement for the pick-up and carrier heads 30 relative to the support elements 1; this relative movement is superimposed over the primary rotational movement of the transfer units 17, i.e. of the support elements 1. In the illustrated embodiment, the drive movement is received by a driving mechanism 18 that is accommodated in the lower portion of the machine frame 11, and that conveys drive movement via a vertical drive shaft 19. The driving mechanism 18 is also provided for driving the conveyer belt or track 12 for delivering the bottles 13, and for driving the conveyer belt or track 14, which delivers the empty bottle boxes 15 or withdraws the filled bottle boxes 15, and is disposed lower than the plane of the path of the conveyer track 12.

The transfer units 17, while maintaining a uniform spacing therebetween, are mounted on an annular or donut-disk plate 2 of a cup-shaped rotary carriage 20 that is rotatably mounted in the machine housing 16 via a ball-bearing turning gear arrangement 3, and that has a gear ring 4 formed on the rotating bearing portion of the ball-bearing turning gear arrangement 3. The gear ring 4, through the interposition of a gear wheel 5, is continually rotated via a gear wheel 21 that is driven by the drive shaft 19. As a result, a continuous rotational movement along the circular path K is imparted to the transfer units 17, and hence to the support elements 1 thereof.

Figure 3:
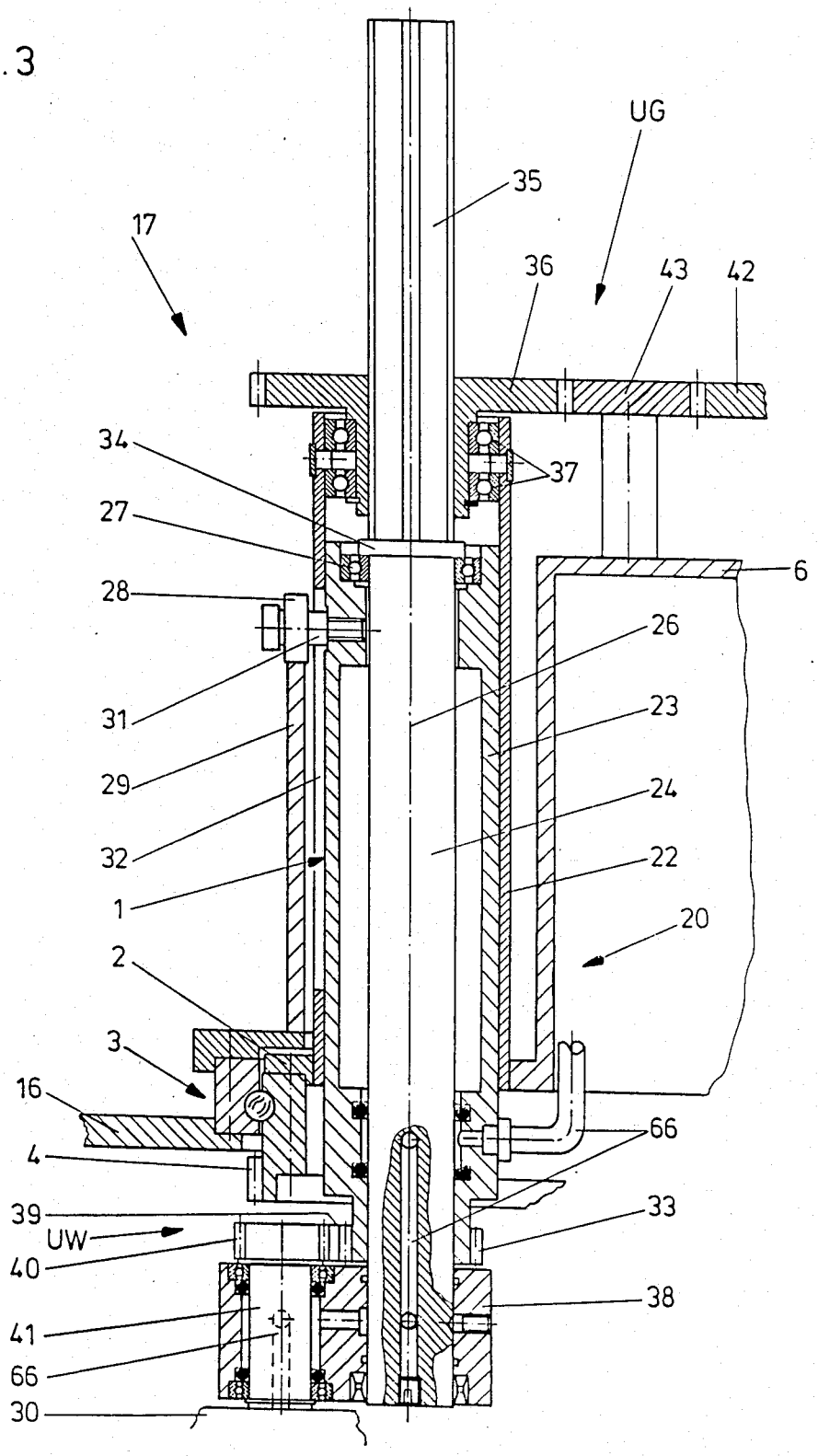
FIG. 3 is somewhat enlarged cross-sectional view through a transfer unit of the machine of FIGS. 1 and 2.

As shown in FIG. 3, each transfer unit 17 has an outer, preferably cylindrical housing 22 that is fixedly placed in the annular plate 2 of the rotary carriage 20. An inner guide housing 23 is mounted within the outer housing 22 in such a way as to be axially displaceable. The guide housing 23 accommodates a vertical main shaft 24, with the axis of the latter at the same time forming the vertical axis 26 of the transfer unit 17 and support element 1, with this vertical axis 26 travelling along the circular path K. In the upper part, the guide housing 23 contains an axially and radially effective bearing or mounting 27 for the main shaft 24. Attached below this mounting 27, and in the side of the guide housing 23, is a control roller 28 which, for generating the raising and lowering movements for the support element 1, which essentially comprises the guide housing 23 and the main shaft 24, and carries the pick-up and carrier head 30, rotates in such a way on a control track 29, which is associated with the fixed part of the machine housing 16 and is indicated by dashed lines in FIG. 1 and dot-dash lines in FIGS. 6 and 8, that the bottles 13 which are conveyed via the conveyer track 12 in a group that is divided-off from a column of bottles are reliably picked up and subsequently also reliably placed in that bottle box 15 that is assigned by the conveyer track 14 to this group of bottles. Also assured is that the respectively filled bottle box 15 is conveyed in an unobstructed manner by the pick-up and carrier head 30 via the conveyer track 14. The shaft 31 of the control roller 28 is secured to the guide housing 23 and extends through a vertical slot 32 in the outer housing 22, so that the guide housing 23 is prevented from turning within the outer housing 22, and hence also relative to the annular plate 2 of the rotary carriage 20. Formed at the bottom end of the guide housing 23 is a sun wheel 33.

Above a collar 34 that rests upon the axial-radial mounting 27, the shaft region 35 of the main shaft 24 is embodied in the manner of a spline shaft, and is axially displaceably guided in a corresponding hub of a planetary wheel 36. This planetary wheel 36 is rotatably supported in the upper end of the outer housing 22 via radial antifriction bearings 37. Fixedly mounted on the lower end of the main shaft 24 is a pivot arm 38 in which is mounted an intermediate gear 39 (see FIGS. 3, 5, and 7) that meshes with the sun wheel 33, and with which a planetary gear 40 meshes. Together with the pivot arm 38, the sun wheel 33, and the intermediate gear 39, the planetary gear 40 forms a further sun-and-planet gearing UW that assures the parallel positioning of the pick-up and carrier head 30, and that is a component of the drive mechanism for the movement apparatus for generating the superimposed relative movement. The planetary gear 40 is rigidly connected to a driven pin 41 that is rotatably mounted in the pivot arm 38, is disposed vertically, and supports the pick-up and carrier head 30 at its lower end. The rotational movement of the planetary wheel 36 can be effected in various ways. In the embodiment illustrated in FIGS. 1 and 4, a central, fixed gear wheel 42 is disposed within the machine housing 16. This gear wheel 42 is secured on a shaft 7 that is mounted in the upper circular plate 6 of the rotary carriage 20. The upper end of the shaft 7 extends upwardly beyond the fixed gear wheel 42 and carries a conventional distributor 8 for supplying compressed air to the pick-up and carrier head 30; the distributor 8 is connected to a source of compressed air. By means of an arm 9 that is connected to the top of the distributor 8, the shaft 7 is connected to the stationary portion of the machine housing 16 in such a way that the fixed gear wheel 42 and the stationary portion of the distributor 8 are prevented from rotating, and hence remain fixed during rotation of the rotary carriage 20. Provided for each planetary wheel 36 of a transfer unit 17 is an intermediate gear 43 that meshes with the fixed gear wheel 42. The fixed gear wheel 42, the planetary wheels 36, the intermediate gears 43, as well as the rotary carriage 20 form a common sun-and-planet gearing UG, which is associated with the drive mechanism of the movement mechanism for generating the superimposed relative movement, to move the pivot arms 38 of the support elements 1, and hence the pick-up and carrier heads 30. The transmission ratios of the fixed gear wheel 42 to the planetary wheel 36 are such that with every revolution of the latter about the gear wheel 42, a rotation counter to the direction of revolution of the transfer unit 17 is carried out. Thus, the pivot arm 38 effects a rotation in the opposite (FIGS. 4 to 6) or in the same (FIGS. 7 and 8) direction as the rotation of the transfer unit 27, so that starting from a radially extended position of 0° relative to the vertical central axis 50 (see FIGS. 5 and 7), after a 90° rotation of the transfer unit 17, the pivot arm 38 is pivoted into a radially inwardly directed position. After a further 90° rotation, the pivot arm 38 has moved into the radially outwardly directed position, after a further 90° rotation has moved into the radially inwardly directed position, and from there after a further 90° rotation has moved back into the original radially outwardly directed position. This pivoting movement, which can also be seen from FIG. 4, takes place counter to the direction of rotation 47. As a consequence, there results an essentially elliptical overall path of revolution 49 for the driven pin 41, or for all of the pins 41, of the movement mechanism about the vertical central axis 50. In this connection, the previously described construction of the further sun-and-planet gearing UW assures that the driven pin 41 in the pivot arm 38, and hence the pick-up and carrier head 30 carried thereby, carry out a rotation that is opposite to the rotational movement of the transfer unit 17, in order in this manner, in every position of the transfer unit 17, to maintain the same relative rotational position or alignment of the pick-up and carrier head 30 relative to the conveyer tracks 12 and 14, i.e. to their central axes MA and MG. In this embodiment, to obtain a long enough period of time for receiving the group of bottles 13 from the bottle boxes 15, or for placing the group of bottles 13 into the bottle boxes 15, a movement of the pick-up and carrier heads 30 in the direction of transport of the conveyer tracks 12 and 14 is provided such that a space exists not only between the major axis and the central axis MA of the conveyer track 12, but also between the major axis and the central axis MG of the conveyer track 14. This space is less than the radius of the minor circle of the elliptical overall path of revolution, with the space between the major axis and the central axis MA of the conveyer track 12 being greater than the space between the major axis and the central axis MG of the conveyer track 14. However, the space can also be the same if, for example, the conveyer tracks 12 and 14 are disposed at the same height.

Figure 5:
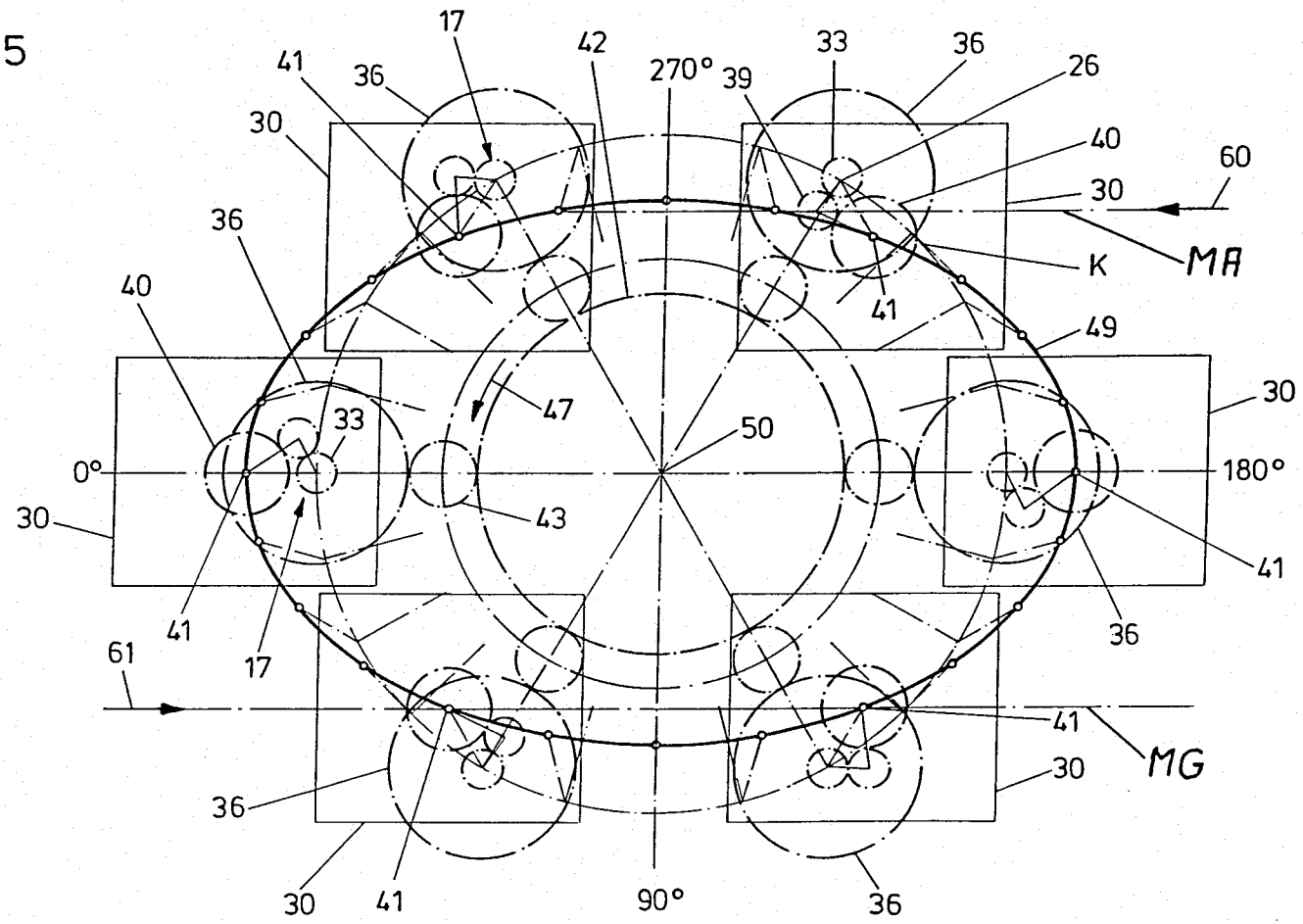
FIG. 5 is a diagrammatic view of the transfer units and pick-up and carrier heads of the embodiment of FIG. 4.
Figure 7:
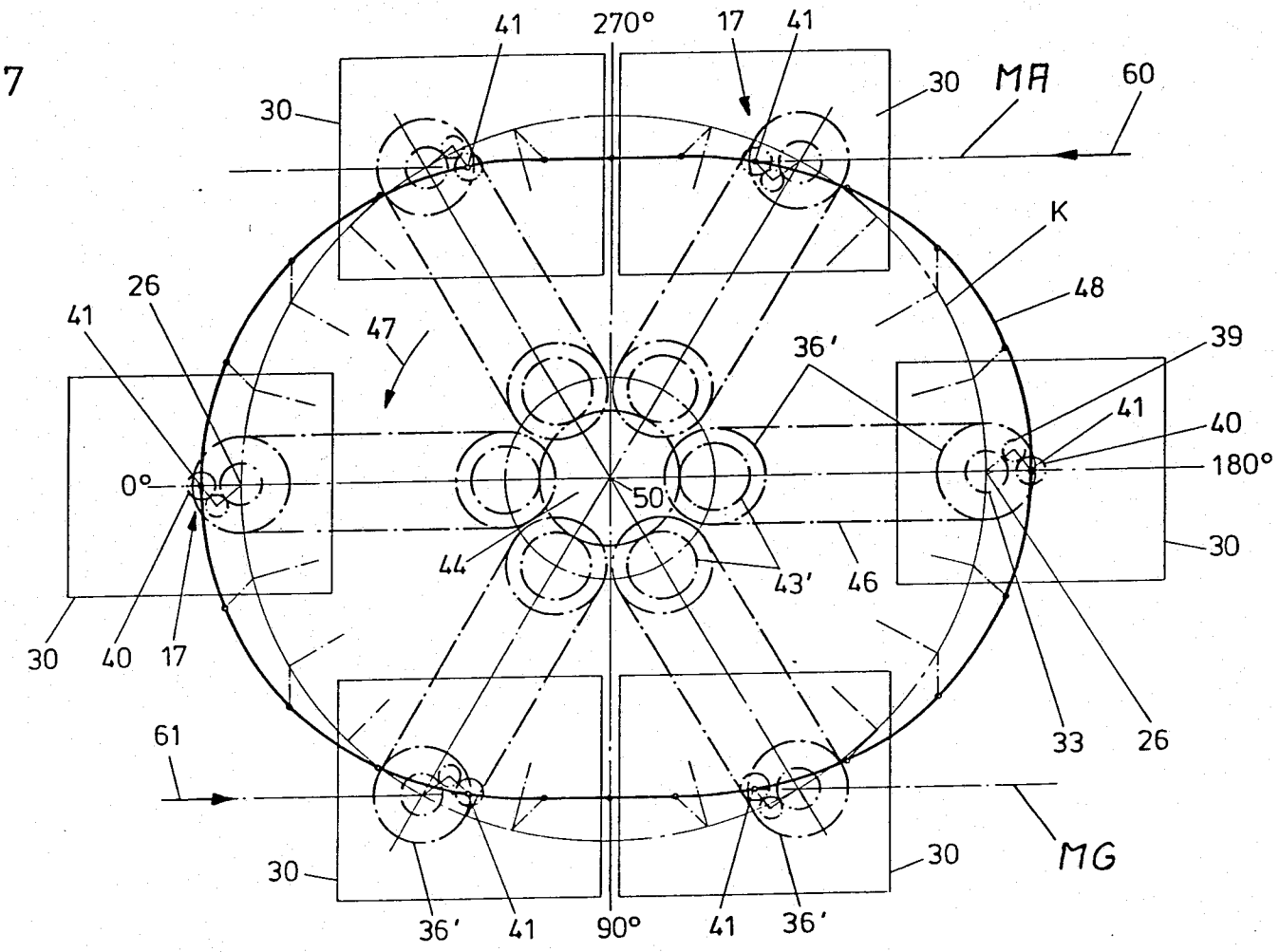
FIG. 7 is a diagrammatic view of the transfer units and pick-up and carrier heads of a modified embodiment for rotation of the pivot arms and transfer units in the same direction.

The embodiment illustrated in FIG. 7 relates to a sun-and-plant gearing UG that is designed for rotation of the pivot arm 38 and the transfer unit 17 in the same direction. As indicated in FIG. 7, with this embodiment the drive of the main shaft 24 is effected via a planetary wheel 43' which meshes directly with a fixed gear wheel 44, and a slipless drive, for example a toothed belt drive, for which purpose a pulley 36' is associated with the drive wheel 43'; the planetary wheel 36 that is in engagement with the main shaft 24 is replaced by a pulley 36', and a toothed belt 46 is provided as a power-transmission means. However, in every case in this embodiment during the time that the transfer unit 17 rotates once about the vertical central axis 50, there is provided relative to the pulley 36', and hence to the main shaft 24, a rotational movement in the same direction as the rotational movement of the transfer unit 17 in conformity with the arrow 47. Due to the fact that the rotational movement of the transfer unit 17, and the support element 1 associated therewith, is in the same direction as the rotational movement of the pulley 36', there results, as can be seen in FIG. 7, an essentially ellipse-shaped overall path of revolution that is a cycloidal path 48 and, in contrast to the path of revolution 49 that is illustrated in FIG. 5 and corresponds to an elliptical shape, has portions that extend parallel to the conveyer tracks 12 and 14, i.e. to their central axes MA and MG, with these portions more closely approaching a linear path, although as a whole the path 48 is still elliptical.

Figure 6:
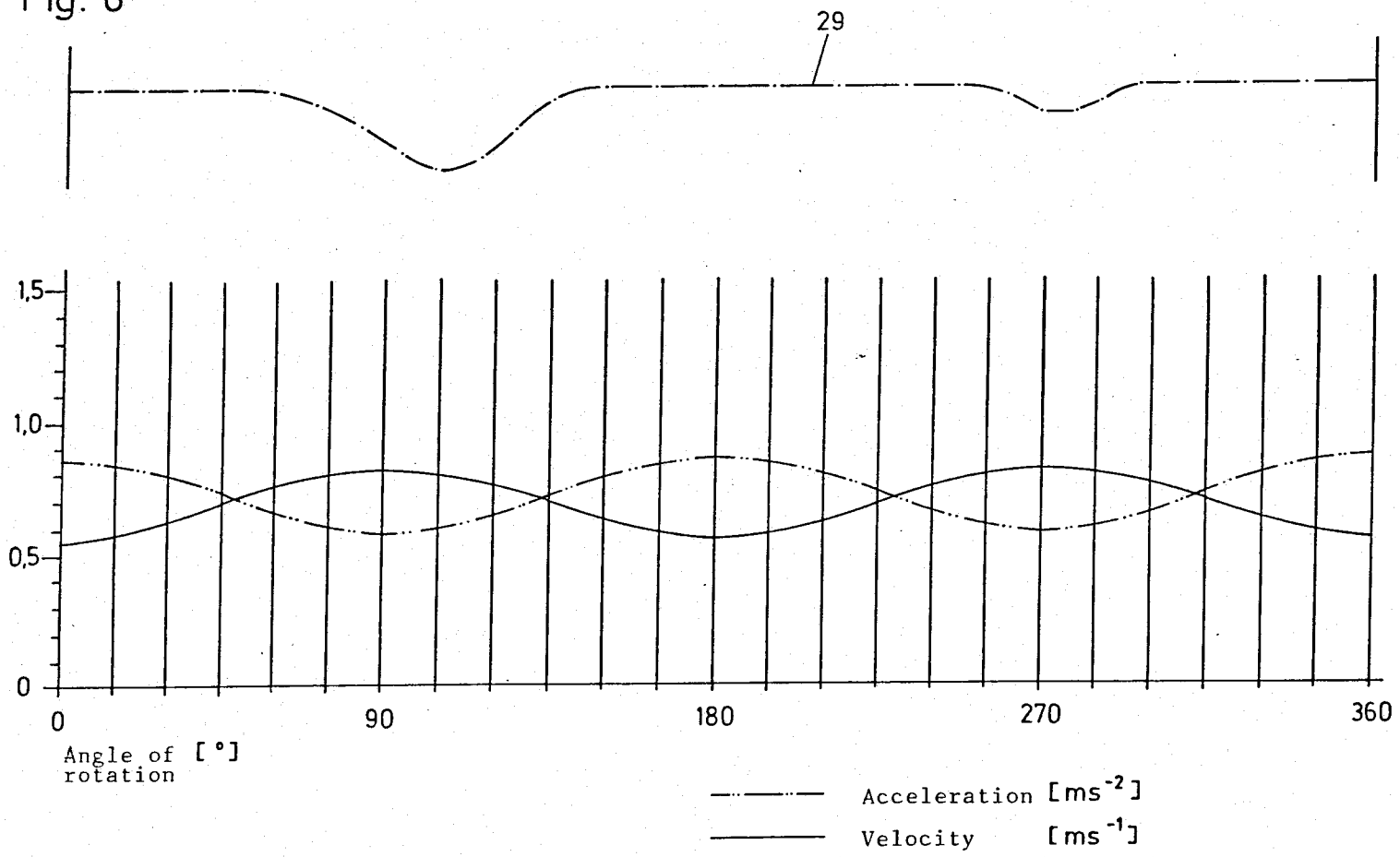
FIG. 6 is a view of a graph showing the acceleration and velocity conditions at the pick-up and carrier head of the embodiment of FIGS. 4 and 5.
Figure 8:
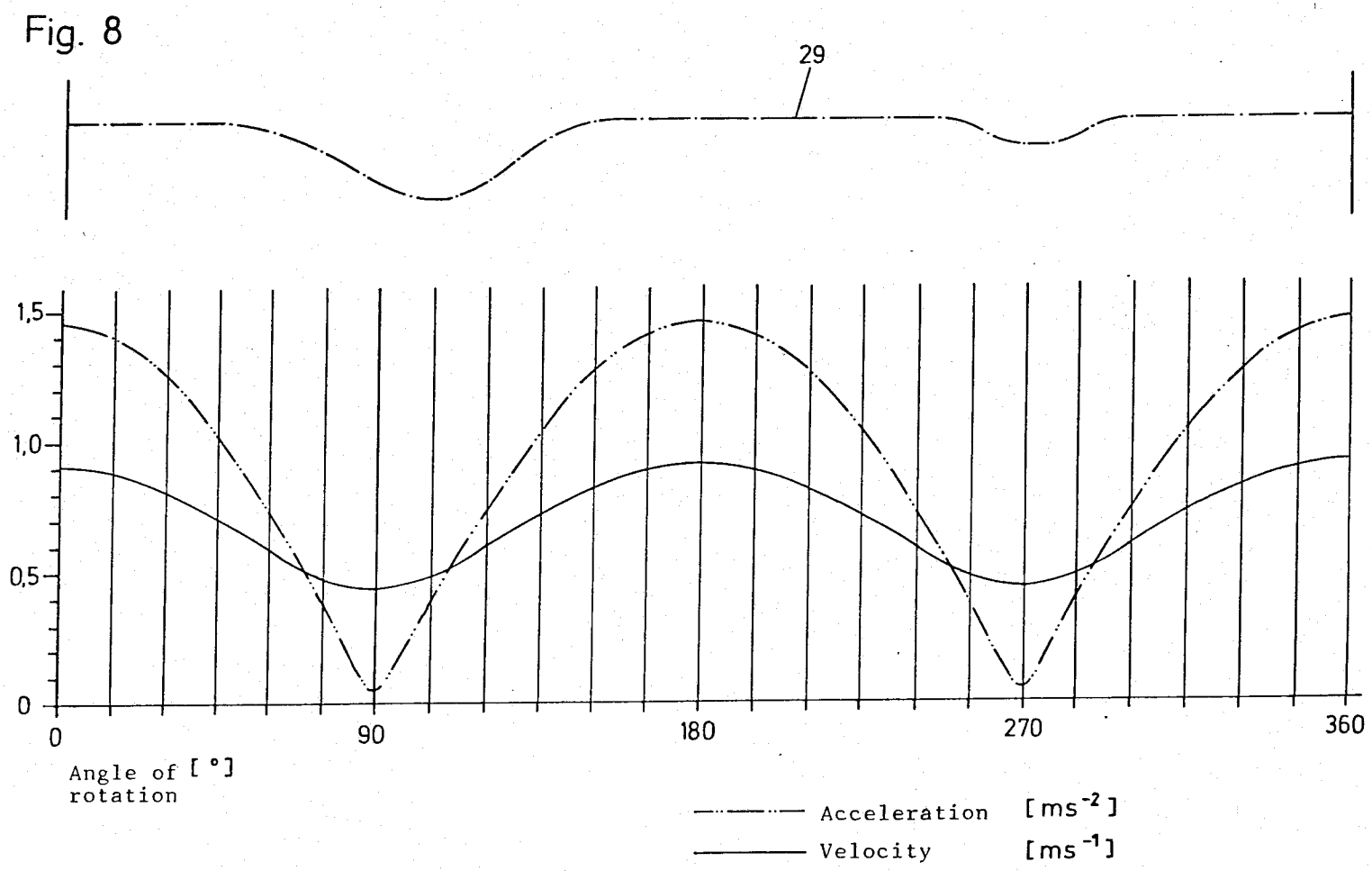
FIG. 8 is a view of a graph showing the acceleration and velocity conditions at the pick-up and carrier head for the embodiment of FIG. 7.

Comparison of FIGS. 6 and 8 shows that in both embodiments the feed velocity of the pick-up and carrier head 30 on its path of movement 48 and 49 varies in the manner of a sine curve as a function of the angular position of the transfer unit 17 at any given time. The curve for the acceleration of the pick-up and carrier head 30 is also uniform. This means that the overall progress of the movement of the pick-up and carrier head 30 along its path of movement 48 and 49 is uniform and smooth. The slight differences between the curves shown in FIG. 6 for the embodiment of FIGS. 4 and 5, and in FIG. 8 for the embodiment of FIG. 7, are insignificant with regard to the basic operating behavior.

Figure 2:
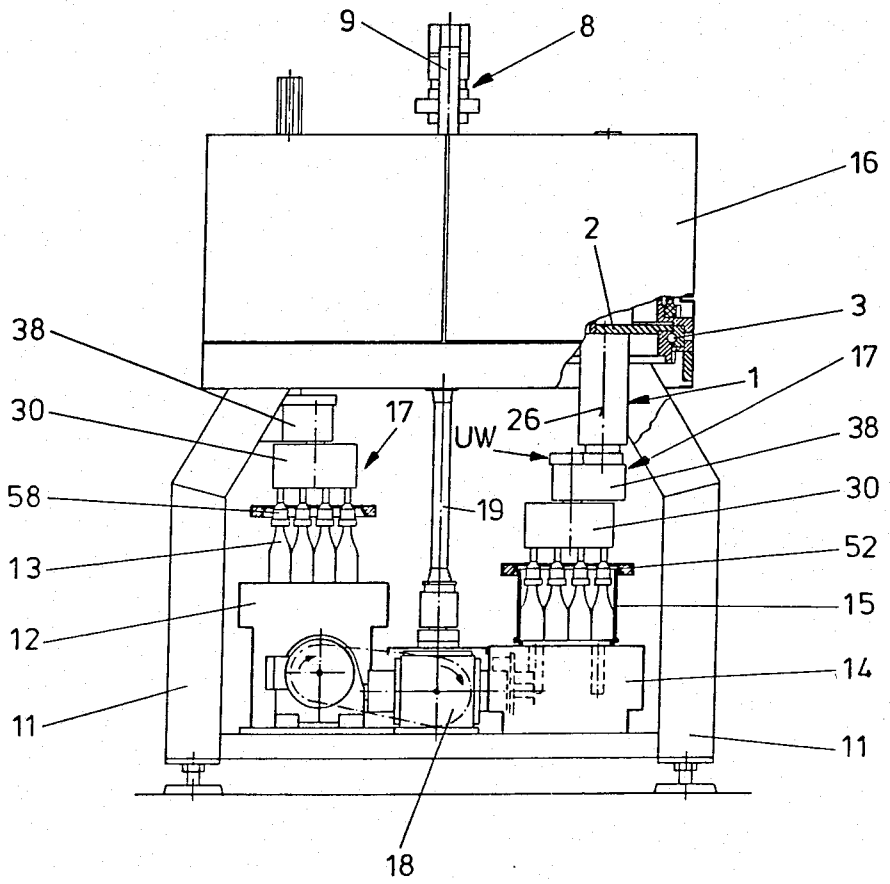
FIG. 2 is a partially sectioned view taken along the line 2—2 in FIG. 1.
Figure 9:
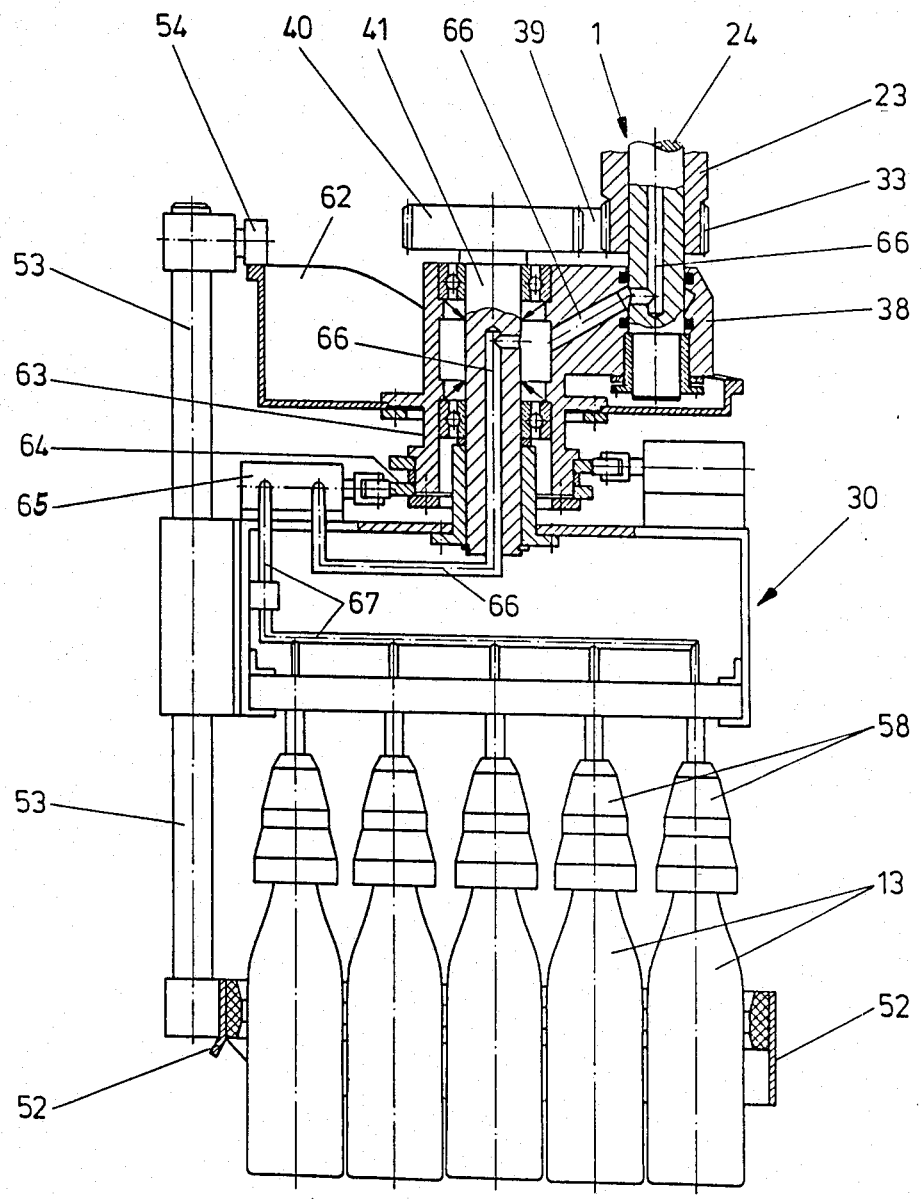
FIG. 9 is a view that shows a pick-up and alignment mechanism for a respective pick-up and carrier head.

As can be seen in FIGS. 1, 2, and 9, in the illustrated embodiments each pick-up and carrier head 30 is provided with a number of conventional pick-up elements 58, the number of which corresponds to the number of bottles 13 that are to be picked up. Each pick-up and carrier head 30 is also equipped with an additional pick-up and alignment mechanism 51 that can be raised and lowered, and that is provided with a centering rack 52 which engages when lowered over the rim of the opening of the respective container or bottle box 15. This centering rack 52 is attached to a pair of guide rods 53, the guide mounts of which are supported on the pick-up and carrier head 30. The guide rods 53 have a guide element 54, which can be a sliding part or a roller. The guide element 54 forms a control element that, as illustrated in FIGS. 1 and 2, can run over control tracks 56 and 57 that are fixedly held on the machine frame 11 and machine housing 16, or, as shown in FIG. 9, can run on a rotating cup-shaped cam 62 that is associated with the respective pick-up and alignment mechanism 51 on the pivot arm 38 that carries the pick-up and carrier head 30. In this way, the guide element 54 controls lowering of the respective centering rack 52 in the entry region of the conveyer track 12 over a bottle box 15 that has been made ready at that location, all for centering relative to the pick-up and carrier head 30, and controls release of the bottle box 15 after the bottles 13 have been transferred at the exit region of the conveyer track 14. Ahead of the region of the conveyer track 12, the centering racks 52 of the transfer units 17 are raised to such an extent that without obstruction of the group of bottles 13 that are to be picked up, the actual pick-up elements 58 can be placed upon the bottles 13. At the exit region of the conveyer track 12, i.e. after the pick-up elements 58 have picked up the group bottles 13, the racks 52 can be lowered to such an extent that they offer an additional support for the bottles 13 during further transport to the conveyer track 14. For actually picking up the group of the bottles 13 via the pick-up elements 58, the latter are supplied with compressed air. For this purpose, a cam 64, which is secured to an extension 63 of the pivot arm 38 that also receives the cup-shaped cam 62, actuates a valve 65, which is mounted on the upper side of the pick-up and carrier head 30, in order to establish a connection from a supply line 66, which is connected to the rotating part of the distributor 8 and supplies compressed air, to a line 67 that interconnects the pick-up elements 58 (see FIG. 9). To actually release the group of bottles 13, when the actuating element of the valve 65 leaves the circumferential cam 64, the connection that exist between the supply line 66 of the line 67 for picking up the group of the bottles 13 is interrupted and the line 67 is open to the atmosphere via the valve 65 for venting the pick-up elements 58.

As can be seen in FIG. 1, provided in the entry region of the conveyer track 14 for the bottle boxes 15 is an allocation mechanism 59 that respectfully provides a bottle box 15 for each arriving pick-up and carrier head 30 that is loaded with bottles 13.

The illustrated embodiments show a packing machine via which groups of bottles 13 are placed in bottle boxes 15. An unpacking machine would be constructed in a similar manner, and would remove groups of bottles 13 from bottle boxes 15 and place them on a conveyer belt for transporting them away. The transport mechanisms are essentially the same as provided for the embodiment in FIG. 1 and indicated by the arrows 60 and 61, although preferably the conveyer belt for transporting away would continue from the left side of FIG. 1, while this conveyer belt would lead in from the right side of FIG. 1.

Instead of bottles 13 in bottle boxes 15, a similar packing and unpacking machine could also be constructed for packing or unpacking other groups of articles into or out of other containers.

The present invention is, of course, in no way restricted to the specific disclosure of the specification and drawings, but also encompasses any modifications within the scope of the appended claims.

What we claim is:

1. A machine for the packing or unpacking of articles into or out of containers, with said machine including a conversion mechanism, for said articles, that is associated with conveyer tracks for said articles and containers, with said conveyer tracks extending parallel to one another and leading to and away from the side of said machine; said conversion mechanism is provided with one or more transfer units that can be moved in a circular path, about a vertical central axis, into and out of the regions above said two conveyer tracks; each transfer unit includes a pick-up and carrier head on a support element that can be raised and lowered in a controlled manner within the appropriate region of said conveyer tracks; each pick-up and carrier head being movable about a vertical axis and being provided with means for receiving, transporting in a suspended manner, and depositing a group of articles associated with an accommodating space within a given container; each pick-up and carrier head is also provided with means for aligning a respective container; said machine further comprises:

a movement mechanism for producing a relative movement between said pick-up and carrier heads and their support elements having a rotational movement, with said relative movement being superimposed over the rotational movement of said support elements; said movement mechanism is embodied in such a way that during a respective rotation of said support elements in a circular path about said vertical central axis, said pick-up and carrier heads are moved in a common elliptical or elliptical-like overall path of revolution that has a major axis and a center point coinciding with and disposed on said vertical central axis; each pick-up and carrier head is moved about the vertical axis of movement thereof respectively such that a constant parallel position is maintained relative to said conveyer tracks, with the major axis of said overall path of revolution being disposed between said conveyer tracks and parallel thereto.

2. A machine according to claim 1, in which said movement mechanism, for each pick-up and carrier head, has a respective pivot arm that is mounted on the associated support element and is rotatable about the vertical axis thereof, with said pivot arm being provided with a rotatably mounted driven pin for carrying said pick-up and carrier head and pivoting the latter about its vertical axis; for moving said pick-up and carrier heads along said overall path of revolution, and for moving the latter in such a way as to maintain said parallel position, said movement mechanism is also provided with a drive mechanism that acts on a respective pivot arm and driven pin.

3. A machine according to claim 2, in which, for moving said pick-up and carrier heads along said overall path of revolution, said drive mechanism includes a first sun-and-planet gearing that is common to all of said pivot arms and is driven synchronously with the rotational movement of said transfer units; and in which, for maintaining said parallel position, said drive mechanism also includes, for each driven pin of a pivot arm, a second sun-and-planet gearing, which has a driven element formed by said pivot arm.

4. A machine according to claim 3, in which, for moving said pick-up and carrier heads along an elliptical overall path of revolution, said first sun-and-planet gearing, for each pivot arm, is provided with a planetary wheel seated on the axis of rotation of the latter, and for all of said planetary wheels, is provided with a fixed gear wheel that is seated on said central axis and meshes with respective ones of said planetary wheels via the interposition of respective intermediate gears.

5. A machine according to claim 3, in which, for moving said pick-up and carrier heads along an elliptical cycloidal overall path of revolution, said first sun-and-planet gearing has respective planetary wheels that are assigned to each pivot arm and are embodied as driving pinions, and has a gear wheel that is fixedly seated on said central axis and meshes with said planetary wheels, with respective ones of the latter driving an associated pivot arm via a slipless drive means.

6. A machine according to claim 5, in which said drive means include respective toothed belts and respective pulleys on said pivot arms and on said planetary wheels.

7. A machine according to claim 3, in which said second sun-and-planet gearing is provided with a planetary gear associated with said driven pin of a given pivot arm, and is also provided with a fixed sun wheel on the pertaining support element, with said sun wheel having a toothed rim that is concentric to said vertical axis of said support element and meshes with said planetary gear via an intermediate gear mounted on said pivot arm.

8. A machine according to claim 7, in which each transfer unit has a housing, and the associated support element has a guide housing that can be raised and lowered within said housing of said transfer unit, with a main shaft being rotatably held in said guide housing; said main shaft has an end that projects downwardly out of said guide housing and on which is secured said pivot arm, which carries said pick-up and carrier head of said transfer unit via said drive pin; said main shaft also has a shaft region that projects upwardly out of said guide housing and is embodied as a spline shaft; and in which said first sun-and-planet gearing is provided with wheel means rotatably held in said housing of said transfer unit and drivingly associated with said pivot arm, with said wheel means having hub means that conform to said spline shaft, and in which the latter can be moved in the direction of its vertical axis.

9. A machine according to claim 8, in which said sun wheel of said second sun-and-planet gearing is formed on said guide housing near said downwardly projection end of said main shaft and across from a portion of said pivot arm remote from said last-mentioned end of said main shaft.

10. A machine according to claim 8, which includes a rotatably driven rotary carriage on which said transfer units, with their housings, are disposed in a uniform angular distribution.

11. A machine according to claim 10, in which said first sun-and-planet gearing includes a driven element formed by said rotary carriage, and also includes fixed gear wheel means seated on said central axis and intermediate means with which said fixed gear wheel means meshes, with the latter and said intermediate means being dipsosed on that side of said rotary carriage remote from said pivot arms; and which includes a machine housing on which is secured an arm that secures said fixed gear wheel means against rotation.

12. A machine according to claim 11, in which said rotary carriage is rotatably mounted in said machine housing via a ball-bearing turning gear arrangement that leaves a central portion of said machine free, with said conveyer tracks being guided through this free central portion.

13. A machine according to claim 2, in which each pick-up and carrier head is provided with a pick-up and alignment mechanism for a respective container.

14. A machine according to claim 13, in which said pick-up and alignment mechanism includes a centering rack that can be raised and lowered and is adapted to engage a rim opening of a respective container.

15. A machine according to claim 14, in which said pick-up and alignment mechanism also includes a pair of guide rods that are mounted on said pick-up and carrier head, and via which said centering rack can be raised and lowered relative to the latter; and in which said pair of guide rods are provided with guide element means that cooperate with a curved track that effects a raising and lowering movement for said pair of guide rods.

16. A machine according to claim 15, in which said curved track that cooperates with said guide element means is formed by control track means that is mounted on machine housing means and is common to all guide element means.

17. A machine according to claim 15, in which said curved track that cooperates with said guide element means is formed by a cup-shaped cam that is associated with the respective pick-up and alignment mechanism, is secured to said pivot arm, and rotates with the latter.

18. A machine according to claim 1, in which, where said overall path of revolution of said pick-up and carrier heads is elliptical, a space exists not only between the major axis of said elliptical path and the central axis of that conveyer track that transports said group of articles, but also between said major axis and the central axis of that conveyer track that transports empty and full containers, with said space being less than the radius of the minor circle of said elliptical path of revolution.

19. A machine according to claim 18, in which said space between said major axis and said central axis of said conveyer track for said articles is the same or greater than said space between said major axis and said central axis of said conveyer track for said containers.

* * * * *